US007926890B2

(12) United States Patent
Haws, Jr.

(10) Patent No.: US 7,926,890 B2
(45) Date of Patent: Apr. 19, 2011

(54) MODULAR CHECKOUT COUNTER

(76) Inventor: Joe D. Haws, Jr., Shreveport, LA (US)

(*) Notice: Subject to any disclaimer, the term of this patent is extended or adjusted under 35 U.S.C. 154(b) by 578 days.

(21) Appl. No.: 12/009,319

(22) Filed: Jan. 17, 2008

(65) Prior Publication Data

US 2009/0184609 A1 Jul. 23, 2009

(51) Int. Cl.
*A47B 87/00* (2006.01)

(52) U.S. Cl. ..... 312/108; 312/198; 312/263; 312/265.1

(58) Field of Classification Search ..... 312/107, 312/108, 111, 198, 140.2, 140.1, 257.1, 263, 312/265.1–265.4
See application file for complete search history.

(56) References Cited

U.S. PATENT DOCUMENTS

| | | | | | |
|---|---|---|---|---|---|
| 1,261,652 | A * | 4/1918 | Thorn | 312/117 |
| 3,070,416 | A * | 12/1962 | Post | 312/241 |
| 3,169,810 | A * | 2/1965 | Levy et al. | 312/140.1 |
| 3,170,742 | A * | 2/1965 | Berkowitz | 312/108 |
| 4,657,149 | A * | 4/1987 | Masson | 211/194 |
| 5,546,873 | A * | 8/1996 | Conner et al. | 108/90 |
| 5,573,082 | A * | 11/1996 | Conlan et al. | 186/44 |
| 5,694,862 | A * | 12/1997 | Grubb | 108/50.11 |
| 5,943,828 | A * | 8/1999 | Samborn et al. | 52/36.1 |
| 5,967,055 | A * | 10/1999 | Schumacher | 108/50.11 |
| 6,138,558 | A * | 10/2000 | Harrington | 100/102 |
| 6,540,137 | B1 * | 4/2003 | Forsythe et al. | 235/383 |
| 6,729,242 | B2 * | 5/2004 | Kerber | 108/42 |
| 7,240,975 | B2 * | 7/2007 | DeMars | 312/140.2 |
| RE41,093 | E * | 2/2010 | Lutz et al. | 186/61 |
| 2002/0020585 | A1 * | 2/2002 | Cernik et al. | 186/68 |
| 2007/0257585 | A1 * | 11/2007 | Kenny et al. | 312/265.4 |

* cited by examiner

*Primary Examiner* — Janet M Wilkens
*Assistant Examiner* — Dan Rohrhoff
(74) *Attorney, Agent, or Firm* — R. Keith Harrison

(57) ABSTRACT

A modular checkout counter includes a center showcase having first and second ends, a generally elongated left hand showcase provided at the first end of the center showcase, a generally elongated right hand showcase provided at the second end of the center showcase, a box top assembly carried by the center showcase, a left rack assembly carried by one of the center showcase and the left hand showcase and oriented at an obtuse angle with respect to a longitudinal axis of the left hand showcase and a right rack assembly carried by one of the center showcase and the right hand showcase generally adjacent to the left rack assembly and oriented at an obtuse angle with respect to a longitudinal axis of the right hand showcase.

24 Claims, 7 Drawing Sheets

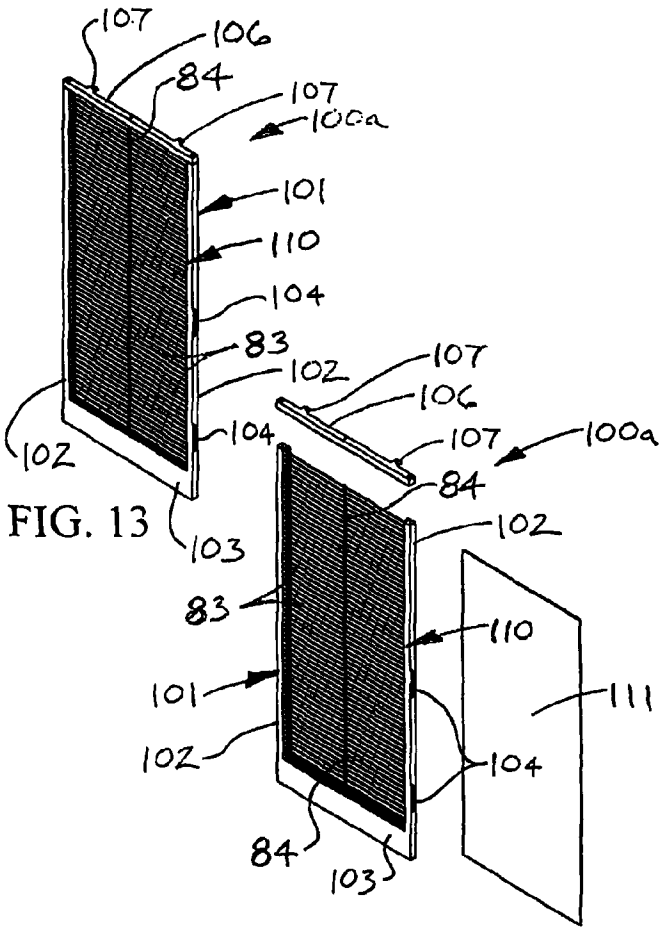
FIG. 13
FIG. 14
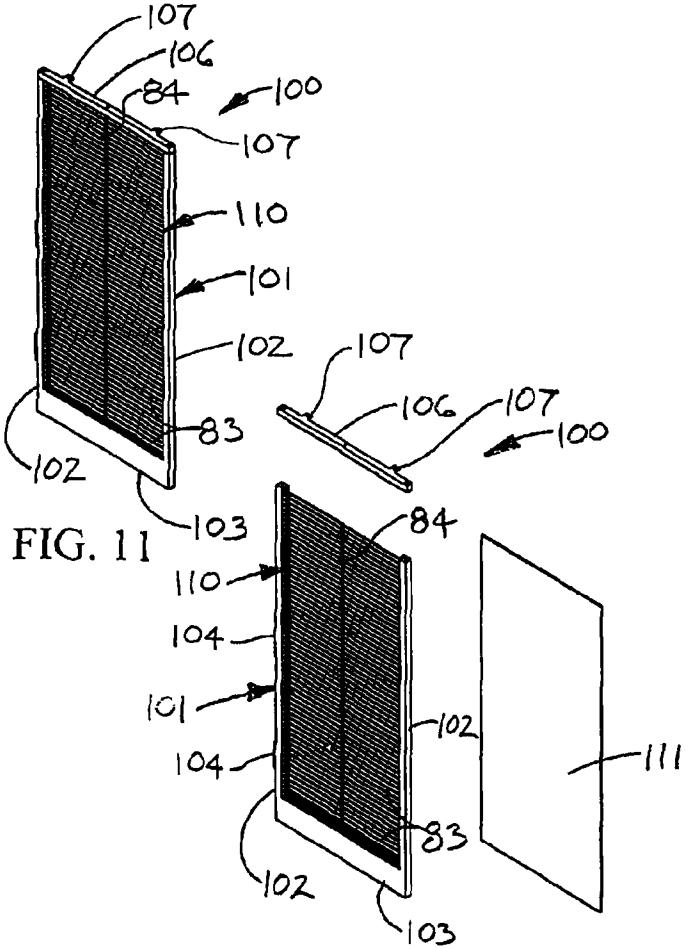
FIG. 11
FIG. 12

MODULAR CHECKOUT COUNTER

FIELD

The present disclosure relates to merchandise storage, display and dispensing systems and the like. More particularly, the present disclosure relates to a modular checkout counter which can be expeditiously assembled on-site and facilitates the storage, display, dispensing and/or checkout of merchandise and the like in addition to support of checkout equipment and the like.

BACKGROUND

Merchandise storage, display and dispensing systems are commonly used in retail outlets to store, display and/or dispense various types of merchandise. Such systems vary considerably in design and may range from relatively simple shelves on which the merchandise is supported to elaborate metal assemblies having multiple arms from which the merchandise is suspended. Some systems may include additional features for supporting checkout equipment and/or other items which are used by sales personnel.

Systems having complex structures may require considerable time and labor to assemble. This may contribute to time and expense in preparing a new retail outlet for use, particularly under circumstances in which the structures must be repeatedly duplicated in chain retail outlets, for example. Under such circumstances, product storage, display and dispensing systems which are amenable to expeditious assembly and installation would be advantageous.

SUMMARY

The present disclosure is generally directed to a modular checkout counter. An illustrative embodiment of the modular checkout counter includes a center showcase having first and second ends, a generally elongated left hand showcase provided at the first end of the center showcase, a generally elongated right hand showcase provided at the second end of the center showcase, a box top assembly carried by the center showcase, a left rack assembly carried by one of the center showcase and the left hand showcase and oriented at an obtuse angle with respect to a longitudinal axis of the left hand showcase and a right rack assembly carried by one of the center showcase and the right hand showcase generally adjacent to the left rack assembly and oriented at an obtuse angle with respect to a longitudinal axis of the right hand showcase.

BRIEF DESCRIPTION OF THE DRAWINGS

The disclosure will now be made, by way of example, with reference to the accompanying drawings, in which:

FIG. 11 is a perspective view of a left rack assembly of an illustrative embodiment of the modular checkout counter;

FIG. 12 is an exploded perspective view of the left rack assembly;

FIG. 13 is a perspective view of a right rack assembly of an illustrative embodiment of the modular checkout counter; and FIG. 14 is an exploded perspective view of the right rack assembly.

DETAILED DESCRIPTION

Figure 1:
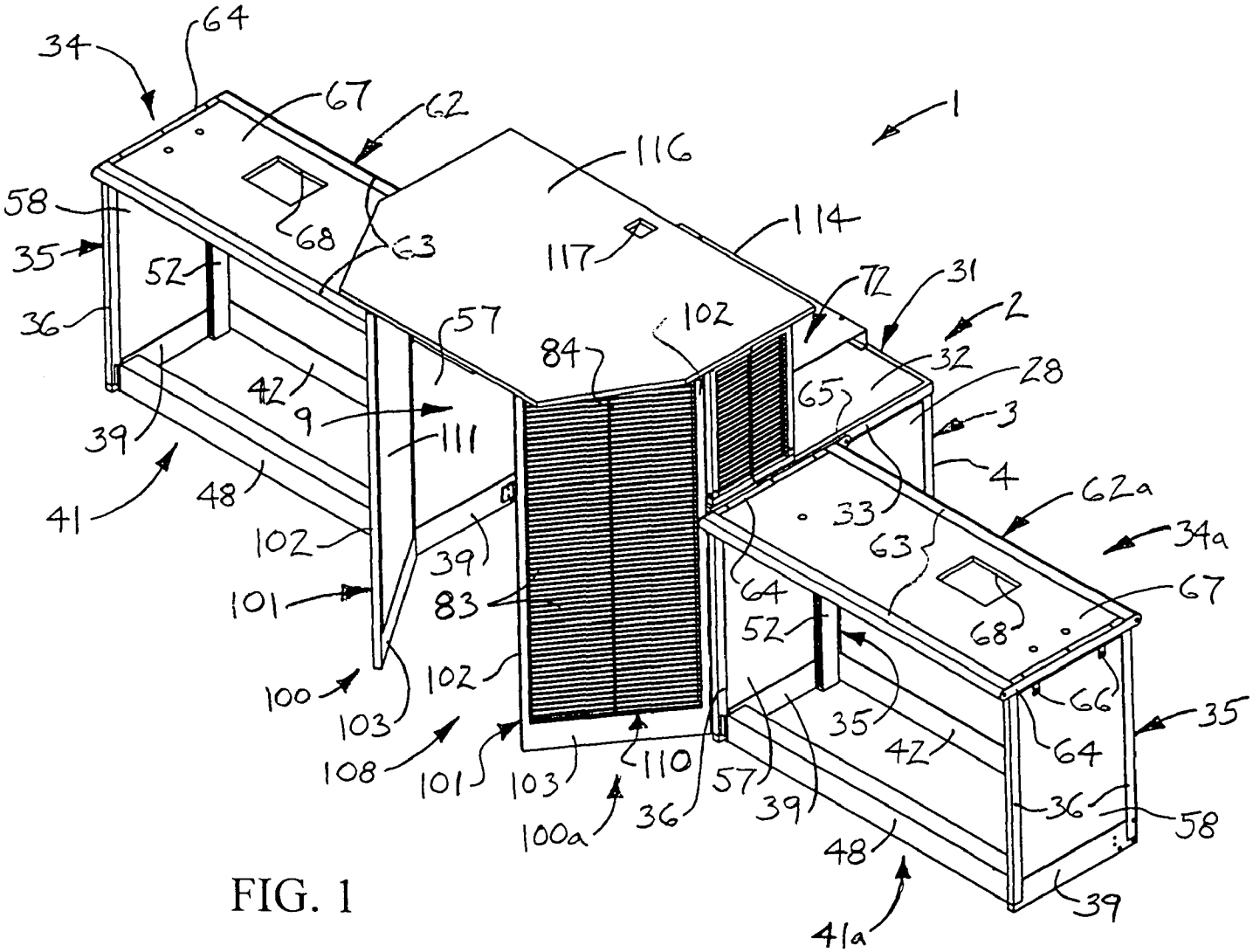
FIG. 1 is a rear perspective view of an illustrative embodiment of the modular checkout counter.
Figure 2:
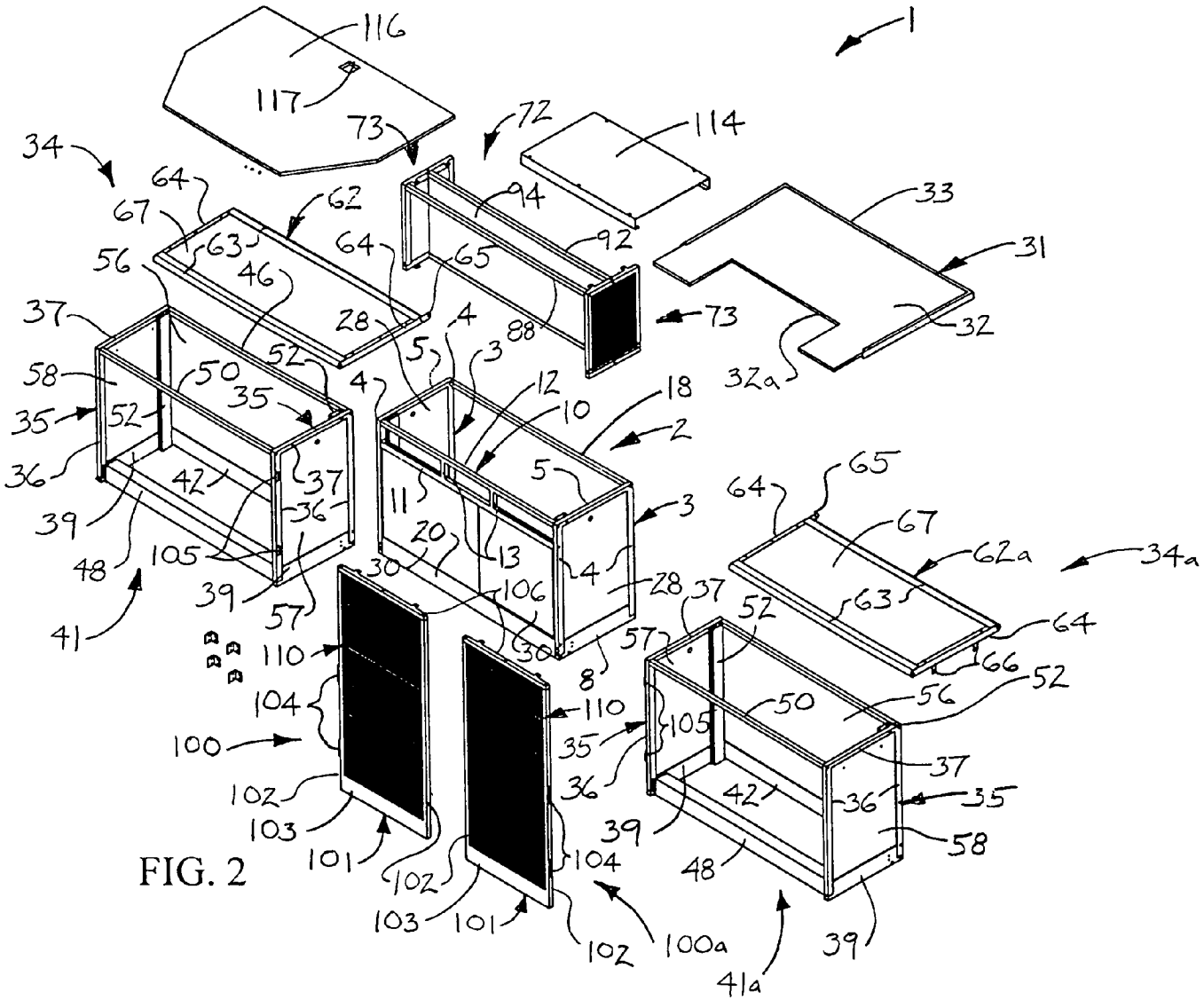
FIG. 2 is an exploded rear perspective view of an illustrative embodiment of the modular checkout counter.
Figure 3:
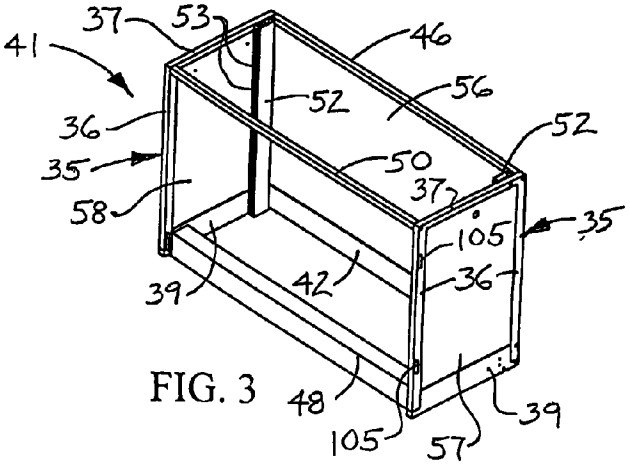
FIG. 3 is a rear perspective view of a left hand showcase of an illustrative embodiment of the modular checkout counter.

Referring initially to FIGS. 1 and 2 of the drawings, an illustrative embodiment of the modular checkout counter is generally indicated by reference numeral 1. The modular checkout counter 1 includes a center showcase 2; a left hand showcase 34 and a right hand showcase 34*a* which are positioned on left and right sides, respectively, of the center showcase 2; a box top assembly 72 which is provided on the center showcase 2, a left rack assembly 100 and a right rack assembly 100*a* which extend from respective ends of the center showcase 2 or from the left hand showcase 34 and the right hand showcase 34*a*, respectively, at respective ends of the center showcase 2; and a top panel 116 which is provided on the box top assembly 72, the left rack assembly 100 and the right rack assembly 100*a*. A drawer shield 114 may be provided on the center showcase 2 for purposes which will be hereinafter described.

Figure 5:
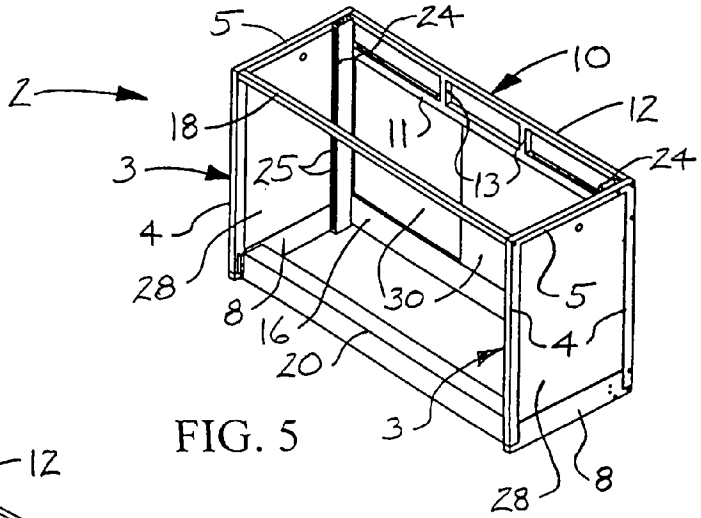
FIG. 5 is a front perspective view of a center showcase of an illustrative embodiment of the modular checkout counter.
Figure 6:
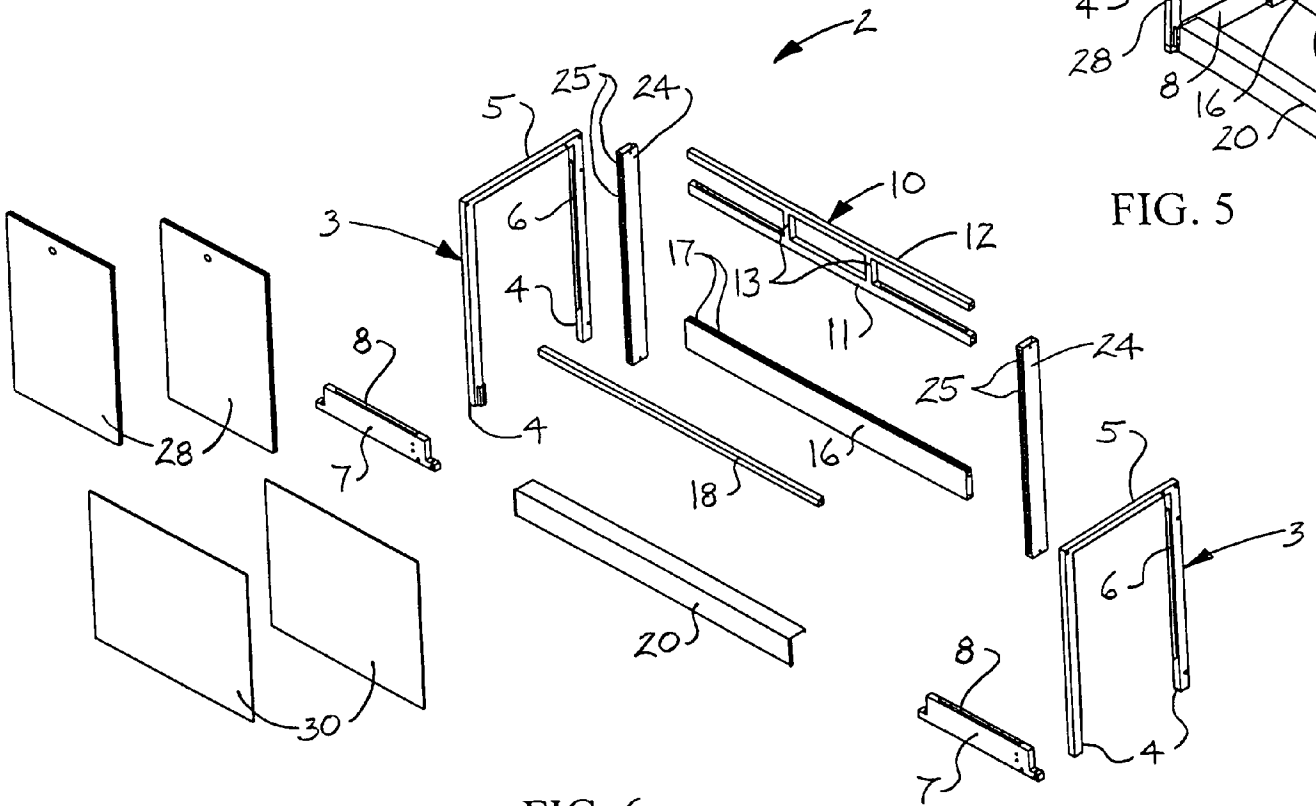
FIG. 6 is an exploded front perspective view of the center showcase.
Figure 7:
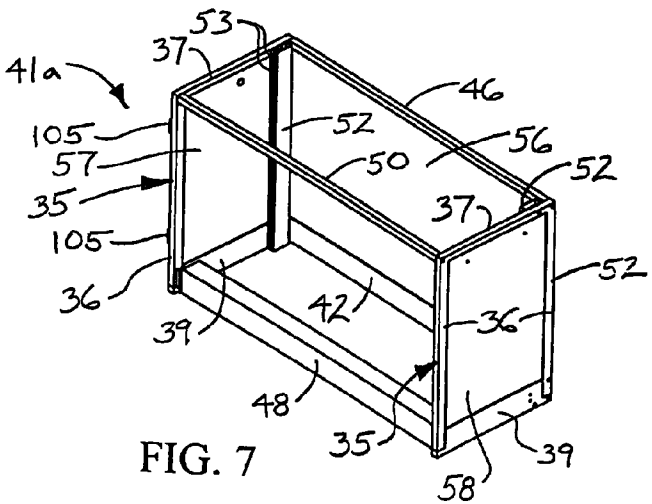
FIG. 7 is a rear perspective view of a right hand showcase of an illustrative embodiment of the modular checkout counter.

Referring next to FIGS. 2, 5 and 6 of the drawings, the center showcase 2 may have a generally elongated, rectangular configuration and includes a pair of spaced-apart center showcase end frames 3. Each center showcase end frame 3 may have a generally inverted U-shaped configuration and may include, for example, a pair of generally elongated, spaced-apart main frame segments 4 and a generally elongated connecting frame segment 5 which connects the main frame segments 4. A generally elongated end frame bottom 7 may span the main frame segments 4. The end frame bottom 7 may be attached to the main frame segments 4 of the corresponding center showcase end frame 3 using fasteners (not illustrated) and/or alternative attachment technique known by those skilled in the art.

An end frame insert panel 28 may be mounted between the main frame segments 4 of each center showcase end frame 3. The end frame insert panel 28 may interface with the main frame segments 4 of the center showcase end frame 3 using any suitable technique which is known by those skilled in the art. In some embodiments, frame blades 6 extend along the respective main frame segments 4 in facing relationship with respect to each other. The frame blades 6 are inserted in respective blade slots (not illustrated) provided in the respective edges of the end frame insert panel 28. An end frame bottom blade 8 may extend along the end frame bottom 7 for insertion into a blade slot (not illustrated) provided in the lower edge of the end frame insert panel 28.

A rear top rail 10, a rear bottom rail 16, a front top rail 18 and a kick plate 20 extend between and connect the center showcase end frames 3 of the center showcase 2. The rear top rail 10 may include, for example, a generally elongated lower rail segment 11; a generally elongated upper rail segment 12 which is disposed in generally parallel, spaced-apart relationship with respect to the lower rail segment 11; and a pair of spaced-apart connecting rail segments 13 which extends between the lower rail segment 11 and the upper rail segment 12. The center showcase end frames 3 may be attached to the rear top rail 10, the rear bottom rail 16, the front top rail 18 and the kick plate 20 using fasteners (not illustrated) and/or alternative attachment techniques known by those skilled in the art.

A pair of sliding doors 30 may be slidably mounted between the rear bottom rail 16 and the lower rail segment 11 of the rear top rail 10 according to any suitable technique which is known by those skilled in the art. As illustrated in FIG. 6, in some embodiments, a pair of rail channels 17 may extend along the rear bottom rail 16 and receive the lower edge of each corresponding sliding door 30. A similar pair of rail channels (not illustrated) may extend along the lower rail segment 11 of the rear top rail 10 and engage the upper edge of each corresponding sliding door 30.

A generally elongated slotted upright member 24 may extend along a main frame segment 4 of each center showcase end frame 3, generally adjacent to the rear top rail 10 and the rear bottom rail 16. Multiple slots 25 may be provided in each slotted upright member 24 for purposes which will be hereinafter described. Each slotted upright member 24 may be attached to the main frame segment 4 of the corresponding center showcase end frame 3 using fasteners (not illustrated) and/or alternative attachment technique known by those skilled in the art.

As illustrated in FIGS. 1 and 2, a center showcase top assembly 31 is provided on the center showcase 2. As illustrated in FIG. 2, the center showcase top assembly 31 may include, for example, a top assembly panel frame 33 which may have a generally C-shaped configuration. A top assembly panel 32 is provided in the top assembly panel frame 33. A panel notch 32*a* may be provided in the top assembly panel 32.

Referring next to FIGS. 1-4, 7 and 8 of the drawings, the left hand showcase 34 of the modular checkout counter 1 includes a showcase base 41 (FIGS. 3 and 4) and a showcase top assembly 62 which is provided on the showcase base 41. The right hand showcase 34*a* includes a showcase base 41*a* (FIGS. 7 and 8) and a showcase top assembly 62*a* which is provided on the showcase base 41*a*. The showcase base 41 of the left hand showcase 34 and the showcase base 41*a* of the right hand showcase 34*a* may have a similar construction and may generally be mirror-images of each other. Likewise, the showcase top assembly 62 of the left hand showcase 34 and the showcase top assembly 62*a* of the right hand showcase 34*a* may have a similar construction and may be mirror-images of each other. The showcase base 41 and the showcase top assembly 62 of the left hand showcase 34 and the showcase base 41*a* and the showcase top assembly 62*a* of the right hand showcase 34*a* may have a generally elongated, rectangular configuration.

As illustrated in FIGS. 3, 4, 7 and 8, each of the showcase base 41 (FIGS. 3 and 4) of the left hand showcase 34 and the showcase base 41*a* (FIGS. 7 and 8) of the right hand showcase 34*a* includes a pair of spaced-apart showcase end frames 35. Each showcase end frame 35 may have a generally U-shaped configuration and may include, for example, a pair of generally elongated, spaced-apart main frame segments 36 and a generally elongated connecting frame segment 37 which connects the main frame segments 36. A generally elongated end frame bottom 39 may span the main frame segments 36. The end frame bottom 39 may be attached to the main frame segments 36 of the corresponding showcase end frame 35 using fasteners (not illustrated) and/or alternative attachment technique known by those skilled in the art.

Figure 4:
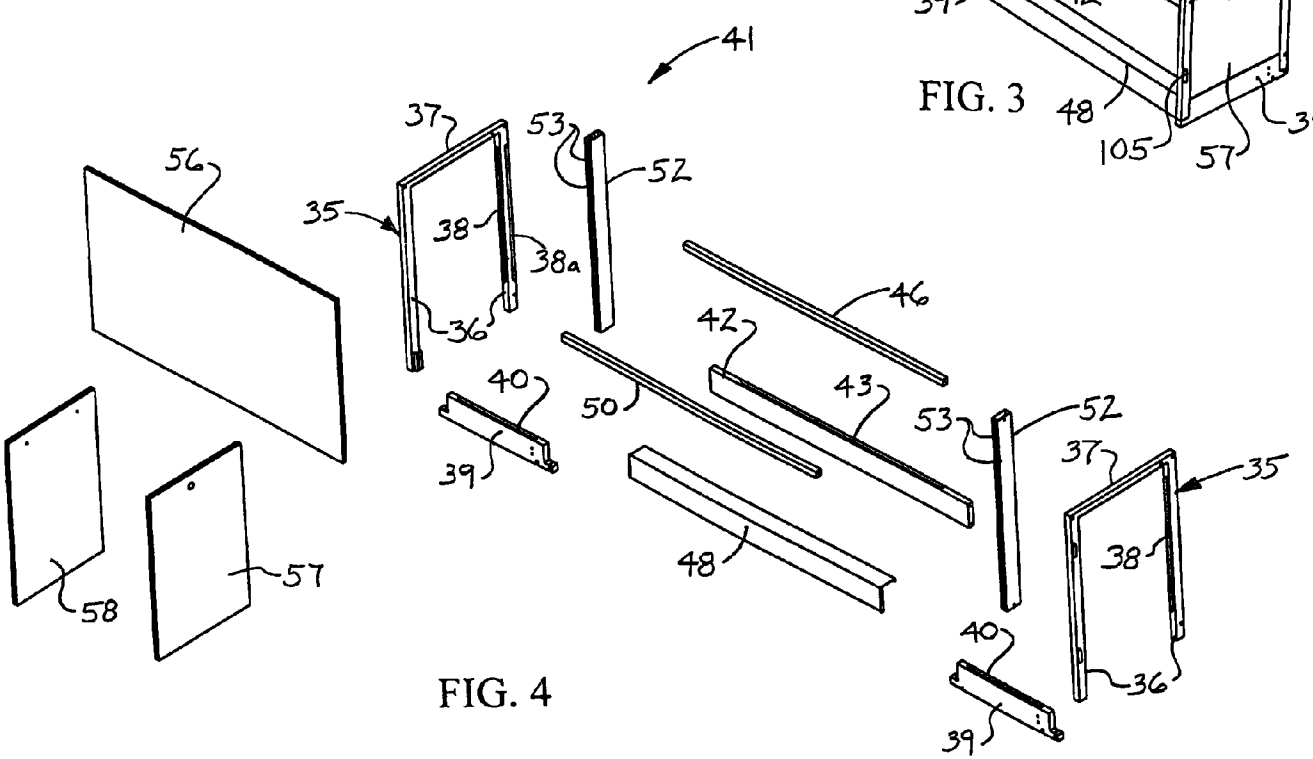
FIG. 4 is an exploded rear perspective view of the left hand showcase.
Figure 8:
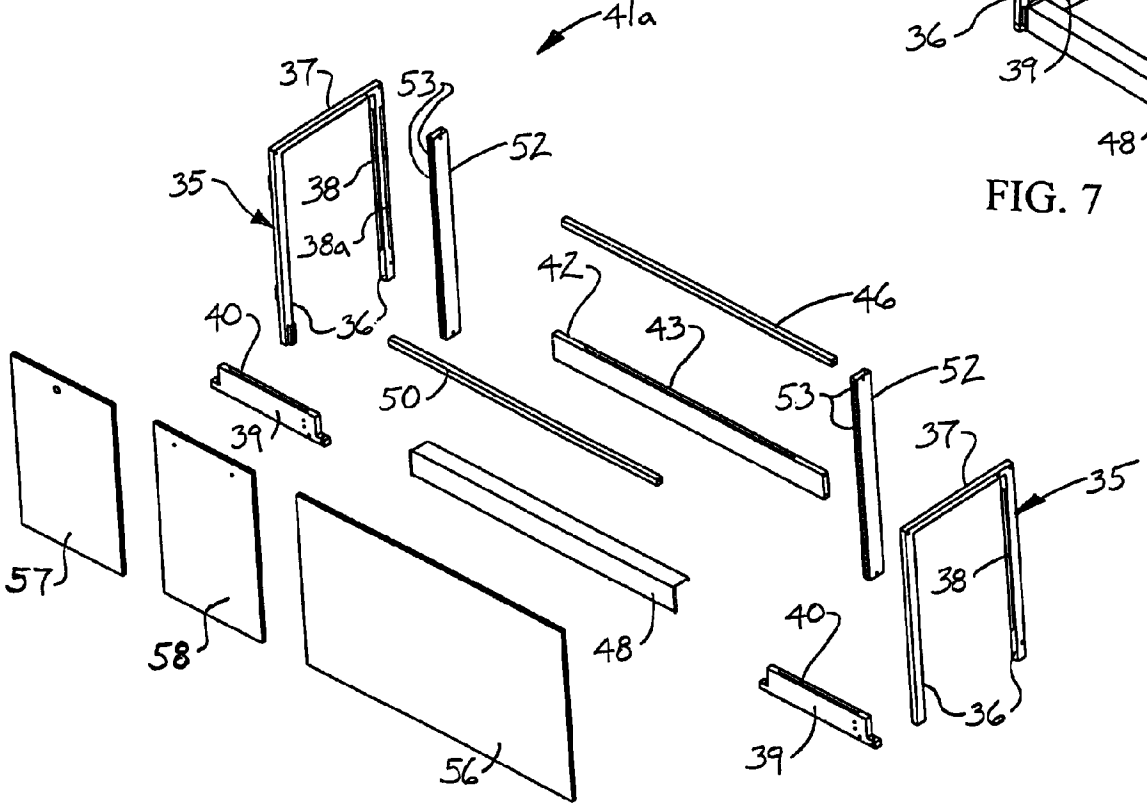
FIG. 8 is an exploded rear perspective view of the right hand showcase.

An inside end panel 57 may be mounted between the main frame segments 36 of one showcase end frame 35. An outside end panel 58 may be mounted between the main frame segments 36 of the other showcase end frame 35. The inside end panel 57 and the outside end panel 58 of the corresponding showcase end frame 35 may interface with the main frame segments 36 of the showcase end frame 35 using any suitable technique which is known by those skilled in the art. As illustrated in FIGS. 4 and 8, in some embodiments, frame blades 38 (one of which is shown) extend along the respective main frame segments 36 in facing relationship with respect to each other. The frame blades 38 are inserted into blade slots (not illustrated) provided in respective edges of the inside end panel 57 and the outside end panel 58. As illustrated in FIG. 4, an end frame bottom blade 40 may extend along the end frame bottom 39 for insertion into a companion blade slot (not illustrated) provided in a lower edge of the corresponding inside end panel 57 and outside end panel 58.

A rear top rail 46, a rear bottom rail 42, a front top rail 50 and a kick plate 48 extend between and connect the showcase end frames 35 of the showcase 41 and the showcase base 41*a*. The showcase end frames 35 may be attached to the rear top rail 46, the rear bottom rail 42, the front top rail 50 and the kick plate 48 using fasteners (not illustrated) and/or alternative attachment techniques known by those skilled in the art.

A main panel 56, which may have a generally elongated and rectangular configuration, may be mounted between the rear bottom rail 42 and the rear top rail 46 according to the knowledge of those skilled in the art. As illustrated in FIGS. 4 and 8, in some embodiments, a rail blade 43 may extend along the rear bottom rail 42 for insertion into a companion blade slot (not illustrated) provided in the lower edge of the main panel 56. A similar rail blade (not illustrated) may extend along the rear top rail 46 for insertion into a companion blade slot (not illustrated) provided in the upper edge of the main panel 56.

A generally elongated slotted upright member 52 may extend along a main frame segment 36 of each showcase end frame 35, generally adjacent to the rear top rail 46 and the rear bottom rail 42. Multiple slots 53 (FIG. 8) may be provided in each slotted upright member 52 for purposes which will be hereinafter described. Each slotted upright member 52 may be attached to the main frame segment 36 of the corresponding showcase end frame 35 using fasteners (not illustrated) and/or alternative attachment technique known by those skilled in the art. Additionally, as illustrated in FIGS. 4 and 8, in some embodiments a frame blade 38*a* may extend along a main frame segment 36 of each showcase end frame 35. A companion blade slot (not illustrated) may be provided in each slotted upright member 52 and receive the frame blade 38*a* to additionally secure each slotted upright member 52 to the corresponding main frame segment 36.

As further illustrated in FIGS. 1 and 2, the left hand showcase 34 includes a showcase top assembly 62 which is provided on the showcase base 41 and the right hand showcase 34*a* includes a showcase top assembly 62*a* which is provided on the showcase base 41*a*. The showcase top assembly 62 of the left hand showcase 34 and the showcase top assembly 62*a* of the right hand showcase 34*a* may include, for example, a pair of generally elongated, parallel, spaced-apart longitudinal frame members 63. A pair of transverse frame members 64 connects the longitudinal frame members 63 at respective ends of the longitudinal frame members 63. A top assembly panel 67, which may have a generally elongated, rectangular configuration, is mounted in the longitudinal frame members 63 and the transverse frame members 64. As illustrated in FIG. 1, a scan slot 68 may be provided in the top assembly panel 67 of each showcase top assembly 62, 62*a* for purposes which will be hereinafter described.

The showcase top assembly 62 and the showcase top assembly 62*a* may be attached to the showcase base 41 of the left hand showcase 34 and the showcase base 41*a* of the right hand showcase 34*a*, respectively, using any suitable technique which is known by those skilled in the art. As illustrated in FIG. 2, in some embodiments, a pair of spaced-apart side flanges 66 extends from a transverse frame member 64 of each of the showcase top assembly 62 and the showcase top assembly 62*a* and receives a pair of threaded fasteners (not illustrated) which are threaded through respective fastener openings (not numbered) provided in the outside end panel 58 of the showcase base 41 and the showcase base 41*a*, respectively. The showcase top assembly 62 and the showcase top assembly 62*a* may be attached to the center showcase top assembly 31 using any suitable technique which is known by those skilled in the art. In some embodiments, an end flange 65 may extend from a transverse frame member 64 of each showcase top assembly 62, 62*a* to receive a threaded fastener (not illustrated) which is threaded through a registering fastener opening (not illustrated) provided in the top assembly panel frame 33 of the center showcase top assembly 31.

Figure 9:
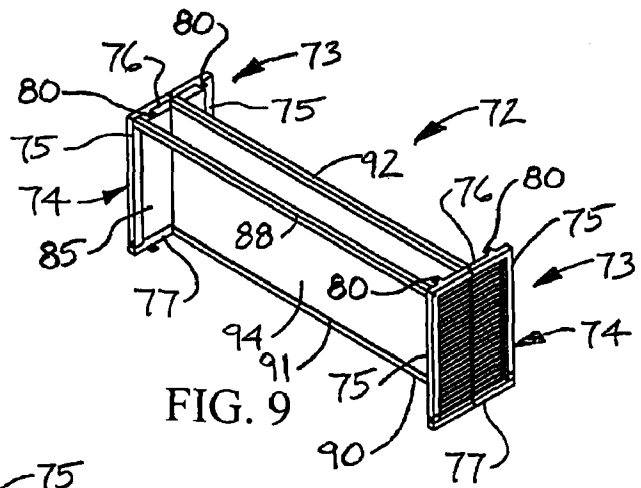
FIG. 9 is a rear perspective view of a box top assembly of an illustrative embodiment of the modular checkout counter.
Figure 10:
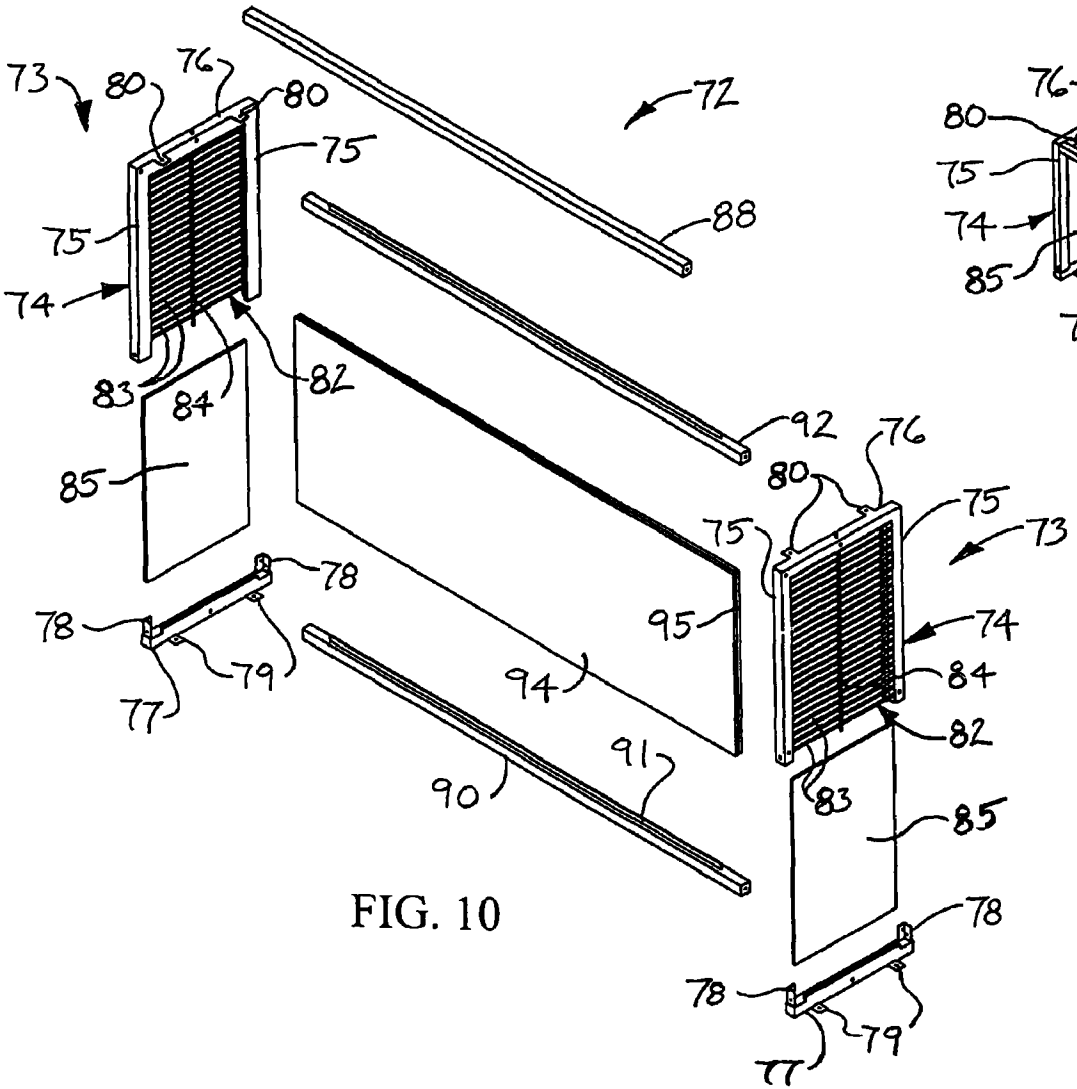
FIG. 10 is an exploded rear perspective view of the box top assembly.

Referring next to FIGS. 2, 9 and 10 of the drawings, the box top assembly 72 of the modular checkout counter 1 includes a pair of spaced-apart end frame assemblies 73. Each end frame assembly 73 includes an end frame 74 which may have a generally inverted U-shaped configuration. The end frame 74 includes a pair of generally elongated, parallel, spaced-apart main frame segments 75 and a generally elongated connecting frame segment 76 which connects the main frame segments 75. A generally elongated end frame bottom 77 may be attached to the main frame segments 75 of the connecting frame segment 76. The end frame bottom 77 may be attached to the main frame segments 75 of the connecting frame 76 using any suitable technique which is known by those skilled in the art. In some embodiments, a pair of spaced-apart end frame bottom attachment flanges 78 extends from the end frame bottom 77. A fastener (not illustrated) is extended through a fastener opening (not illustrated) provided in each end frame bottom attachment flange 78 and through a registering fastener opening (not numbered) provided in each main frame segment 75.

An end frame hanging rack 82 is mounted in the end frame 74 of each end frame assembly 73. Each end frame hanging rack 82 may include multiple, generally parallel, spaced-apart rack rods 83 and a reinforcing member 84 which extends transverse to the rack rods 83. An end frame insertion panel 85, which may have a generally elongated rectangular configuration, may be provided in the end frame 74 of each end frame assembly 73. As illustrated in FIG. 9, in each end frame assembly 73, the end frame insertion panel 85 is typically located to the inside of the corresponding end frame hanging rack 82.

A generally elongated assembly frame member 88 extends between the end frame assemblies 73 of the box top assembly 72. A bottom panel insert frame 90 and a top panel insert frame 92 also extend between the end frame assemblies 73. The assembly frame member 88, the bottom panel insert frame 90 and the top panel insert frame 92 may be attached to each end frame assembly 73 using any suitable technique which is known by those skilled in the art. In some embodiments, fasteners (not illustrated) are extended through fastener openings (not numbered) provided in each end frame 74 and threaded into respective fastener openings (not numbered) provided in the respective assembly frame member 88, bottom panel insert frame 90 and top panel insert frame 92.

An insert panel 94, which may have a generally elongated, rectangular configuration, extends between the end frame assemblies 73 and between the bottom panel insert frame 90 and the top panel insert frame 92. The insert panel 94 may be attached to the bottom panel insert frame 90 and the top panel insert frame 92 using any suitable technique which is known by those skilled in the art. In some embodiments, a frame blade 91 extends along the bottom panel insert frame 90 and is inserted in a companion blade slot 95 provided in the edge of the insert panel 94. A frame blade (not illustrated) may also extend from the top panel insert frame 92 for insertion in the blade slot 95.

The box top assembly 72 may be attached to the center showcase 2 or the left hand showcase 34 and right hand showcase 34*a* using any suitable technique which is known by those skilled in the art. As illustrated in FIG. 10, in some embodiments, a pair of spaced-apart box top assembly attachment flanges 79 extends from the end frame bottom 77 of each end frame assembly 73. Fasteners (not illustrated) are extended through fastener openings (not illustrated) provided in the respective box top assembly attachment flanges 79 and threaded into respective registering fastener openings (not illustrated) provided in the center showcase 2 or in the left hand showcase 34 and right hand showcase 34*a*.

Referring next to FIGS. 1, 2 and 11-14 of the drawings, the left rack assembly 100 (FIGS. 11 and 12) and the right rack assembly 100*a* (FIGS. 13 and 14) may have a similar construction and may generally be mirror-images of each other. The left rack assembly 100 and the right rack assembly 100*a* may each include a rack assembly frame 101 which may have a generally U-shaped configuration. The rack assembly frame 101 may include, for example, a pair of generally elongated, spaced-apart, parallel main frame segments 102. A generally elongated connecting frame segment 103 extends between and connects the main frame segments 102. A generally elongated, spanning frame top segment 106 may be attached to the main frame segments 102 of the rack assembly frame 101 using any suitable technique, such as by the use of threaded fasteners (not illustrated), for example.

A hanging rack 110 is mounted in the rack assembly frame 101 of the left rack assembly 100 and in the rack assembly frame 101 of the right rack assembly 100*a*, respectively. The hanging rack 110 may include, for example, multiple, parallel, spaced-apart rack rods 83 and a reinforcing member 84 which extends transverse to the rack rods 83. A rack assembly insert panel 111, which may have a generally elongated, rectangular configuration, may be mounted in the rack assembly frame 101. As illustrated in FIG. 1, the rack assembly insert panel 111 is typically located to the inside of the hanging rack 110 of the corresponding left rack assembly 100 and right rack assembly 100*a*.

As illustrated in FIG. 1, the left rack assembly 100 and the right rack assembly 100*a* extend from the inside showcase end frame 35 of the left hand showcase 34 and the right hand showcase 34*a*, respectively. Alternatively, the left rack assembly 100 and the right rack assembly 100*a* may extend from respective ends of the center showcase 2. Each rack assembly 100, 100*a* is oriented at an obtuse angle with respect to the inside end panel 57 of the corresponding left hand showcase 34 and right hand showcase 34*a*. Each rack assembly 100, 100*a* may also be oriented at an obtuse angle with respect to the longitudinal axis of the left hand showcase 34 and the right hand showcase 34*a*. The left rack assembly 100 and the right rack assembly 100*a* may be attached to the main frame segment 36 of the corresponding showcase end frame 35 using any suitable technique which is known by those skilled in the art. As illustrated in FIGS. 11-14, in some embodiments, a pair of spaced-apart attachment pins 104 extends from an outside main frame segment 102 of the rack assembly frame 101. As illustrated in FIG. 2, a pair of spaced-apart attachment pin receptacles 105 is provided on the main frame segment 36 of the inside showcase end frame 35 and is adapted to receive the respective attachment pins 104 on the corresponding rack assembly frame 101. Alternatively, each pair of attachment pin receptacles 105 may be provided on the corresponding center showcase end frame 3 of the center showcase 2.

As illustrated in FIGS. 1 and 2, the top panel 116 is attached to the box top assembly 72, the left rack assembly 100 and the right rack assembly 100*a* using any suitable technique which is known by those skilled in the art. As illustrated in FIGS. 9 and 10, in some embodiments a pair of spaced-apart top panel attachment flanges 80 extends from the connecting frame segment 76 of each end frame 74 on the box top assembly 72. Fasteners (not illustrated) are extended through respective fastener openings (not numbered) provided in the respective top panel attachment flanges 80 and threaded into respective fastener openings (not illustrated) provided in the top panel 116 to attach the top panel 116 to the box top assembly 72. As illustrated in FIGS. 11-14, in some embodiments a pair of spaced-apart top panel attachment flanges 107 extends from the frame top segment 106 of each of the left rack assembly 100 and the right rack assembly 100*a*. Fasteners (not illustrated) are extended through respective fastener openings (not numbered) provided in the respective top panel attachment flanges 107 and threaded into respective fastener openings (not illustrated) provided in the top panel 116 to attach the top panel 116 to the left rack assembly 100 and the right rack assembly 100*a*. A power pole opening 117 may extend through the top panel 116 to accommodate a power pole (not illustrated) fitted with multiple electrical outlets (not illustrated). As illustrated in FIG. 1, a module interior 9 is defined by and between the left rack assembly 100 and the right rack assembly 100*a*; the inside end panels 57 of the respective left hand showcase 34 and right hand showcase 34*a*; the end frame assemblies 73 and insert panel 94 (FIG. 9) of the box top assembly 72; and the top panel 116. A panel gap 108 which is defined by and between the left rack assembly 101 and the right rack assembly 101*a* communicates with the module interior 9.

In typical application, the modular checkout counter 1 is assembled in a retail outlet (not illustrated) to store, display and/or dispense merchandise (not illustrated) and/or to support electronic equipment such as computers, checkout devices and the like (not illustrated). Accordingly, the center showcase 2; the left hand showcase 34; the right hand showcase 34*a*; the box top assembly 72; and the left rack assembly 100 and the right rack assembly 100*a* are initially assembled, typically in the manner which was heretofore described. The left hand showcase 34, the right hand showcase 34*a*, the box top assembly 72, the left rack assembly 100 and the right rack assembly 100*a* are attached to the center showcase 2. The top panel 116 is attached to the box top assembly 72, the left rack assembly 100 and the right rack assembly 100*a*. The drawer shield 114 may be placed on the center showcase top assembly 31 on the center showcase 2. A power pole (not illustrated) may be extended through the power pole opening 117 of the top panel 116 and secured in place and connected to a source of electrical power (not illustrated).

Merchandise-supporting brackets (not illustrated), which may be conventional and from which merchandise may be suspended, may be attached to the hanging rack 110 of either or both of the left rack assembly 100 and the right rack assembly 100*a*. The merchandise-supporting brackets may additionally or alternatively be attached to one or both of the end frame hanging racks 82 (FIG. 10) of the box top assembly 72. Merchandise may also be stored out-of-sight in the center showcase 2 by sliding the sliding doors 30 (FIG. 2). Checkout equipment (not illustrated) may be placed on the center showcase top assembly 31 and/or on the showcase top assembly 62, 62*a* of one or both of the left hand showcase 34 and the right hand showcase 34*a*, respectively. Electronic equipment can be plugged into the electrical outlets (not illustrated) of the power pole (not illustrated) to power the electronic equipment. In embodiments in which the scan slot 68 (FIG. 1) is provided in one or both showcase top assemblies 62, 62*a*, electronic barcode scanning equipment (not illustrated) may be placed in the showcase base 41, 41*a* and interface with the scan slot 68 to facilitate barcode scanning of merchandise. Additional merchandise and/or equipment can be placed on the top panel 116. An accessory such as a soda-dispensing machine (not illustrated), for example, may be positioned in the module interior 9 (FIG. 1) and accessed through the panel gap 108 between the left rack assembly 100 and the right rack assembly 100*a* by customers in the retail outlet. It will be appreciated by those skilled in the art that the modular construction of the modular checkout counter 1 facilitates expeditious assembly and installation in retail outlets and can be readily disassembled, as deemed necessary, by reversing the assembly steps which were outlined herein above.

While the illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A modular checkout counter, comprising:

a center showcase having first and second ends;

a generally elongated left hand showcase provided at said first end of said center showcase;

a generally elongated right hand showcase provided at said second end of said center showcase;

a box top assembly carried by said center showcase;

a left rack assembly carried by one of said center showcase and said left hand showcase and oriented at an obtuse angle with respect to a longitudinal axis of said left hand showcase and coextensive with a combined height of said center showcase and said box top assembly; and a right rack assembly carried by one of said center showcase and said right hand showcase generally adjacent to said left rack assembly and oriented at an obtuse angle with respect to a longitudinal axis of said right hand showcase and coextensive with a combined height of said center showcase and said box top assembly.

2. The modular checkout counter of claim 1 wherein said center showcase comprises a pair of spaced-apart center showcase end frames and a plurality of rails extending between said center showcase end frames.

3. The modular checkout counter of claim 2 further comprising a kick plate extending between said center showcase end frames.

4. The modular checkout counter of claim 2 further comprising at least one slotted upright member having a plurality of slots carried by at least one of said center showcase end frames.

5. The modular checkout counter of claim 2 further comprising a pair of sliding doors extending between a pair of said plurality of rails of said center showcase.

6. The modular checkout counter of claim 2 further comprising a pair of end frame insert panels provided in said center showcase end frames, respectively.

7. The modular checkout counter of claim 1 further comprising a top panel carried by said box top assembly, said left rack assembly and said right rack assembly.

8. The modular checkout counter of claim 1 wherein said left hand showcase and said right hand showcase each comprises a showcase base and a showcase top assembly carried by said showcase base.

9. The modular checkout counter of claim 8 wherein said showcase base comprises a pair of spaced-apart showcase end frames and a plurality of rails extending between said showcase end frames.

10. The modular checkout counter of claim 9 further comprising at least one slotted upright member having a plurality of slots carried by at least one of said showcase end frames.

11. The modular checkout counter of claim 9 further comprising an inside end panel provided in a first one of said showcase end frames generally adjacent to said center showcase and an outside end panel provided in a second one of said showcase end frames of said showcase base.

12. The modular checkout counter of claim 9 further comprising a main panel extending between said showcase end frames of said showcase base.

13. A modular checkout counter, comprising:

a generally elongated center showcase having first and second ends;

a generally elongated left hand showcase provided at said first end of said center showcase;

a generally elongated right hand showcase provided at said second end of said center showcase;

a generally elongated box top assembly carried by said center showcase and having a pair of spaced-apart end frame assemblies and a plurality of rails extending between said end frame assemblies;

a left rack assembly carried by one of said center showcase and said left hand showcase and oriented at an obtuse angle with respect to a longitudinal axis of said left hand showcase and coextensive with a combined height of said center showcase and said box top assembly;

wherein said left rack assembly comprises a generally U-shaped rack assembly frame and a hanging rack having a plurality of multiple, parallel, spaced-apart rack rods spanning said rack assembly frame and a reinforcing member extending transverse to said rack rods;

a right rack assembly carried by one of said center showcase and said right hand showcase generally adjacent to said left rack assembly and oriented at an obtuse angle with respect to a longitudinal axis of said right hand showcase and coextensive with a combined height of said center showcase and said box top assembly;

wherein said right rack assembly comprises a generally U-shaped rack assembly frame and a hanging rack having a plurality of multiple, parallel, spaced-apart rack rods spanning said rack assembly frame and a reinforcing member extending transverse to said rack rods;

a top panel carried by said box top assembly and said left rack assembly and said right rack assembly;

a module interior defined by and between said center showcase, said left hand showcase, said right hand showcase, said box top assembly, said left rack assembly and said right rack assembly; and a panel gap defined by and between said left rack assembly and said right rack assembly and communicating with said module interior.

14. The modular checkout counter of claim 13 wherein each of said end frame assemblies of said box top assembly comprises an end frame and an end frame hanging rack provided in said end frame.

15. The modular checkout counter of claim 14 further comprising an end frame insertion panel provided in said end frame.

16. The modular checkout counter of claim 13 wherein each of said left rack assembly and said right rack assembly comprises a rack assembly frame and a hanging rack provided in said rack assembly frame.

17. The modular checkout counter of claim 13 wherein said left hand showcase and said right hand showcase each comprises a showcase base and a showcase top assembly carried by said showcase base.

18. The modular checkout counter of claim 17 further comprising a scan slot provided in said showcase top assembly.

19. The modular checkout counter of claim 17 wherein said showcase base comprises a pair of spaced-apart showcase end frames and a plurality of rails extending between said showcase end frames.

20. The modular checkout counter of claim 17 wherein said showcase top assembly comprises a pair of generally parallel, spaced-apart longitudinal frame members; a pair of transverse frame members extending between said longitudinal frame members; and a top assembly panel mounted between said longitudinal frame members and said transverse frame members.

21. A modular checkout counter, comprising:

a generally elongated center showcase having a pair of spaced-apart center showcase end frames, a pair of end frame insert panels provided in said center showcase end frames, respectively, a plurality of rails connecting said center showcase end frames and a pair of sliding doors extending between a pair of said plurality of rails;

a generally elongated left hand showcase provided at a first end of said center showcase and comprising a left hand showcase base having a pair of spaced-apart first and second showcase end frames, an inside end panel provided in said first showcase end frame, an outside end panel provided in said second showcase end frame, a plurality of rails connecting said showcase end frames and a main panel extending between a pair of said plurality of rails and a left hand showcase top assembly provided on said left hand showcase base;

a generally elongated right hand showcase provided at a second end of said center showcase and comprising a right hand showcase base having a pair of spaced-apart first and second showcase end frames, an inside end panel provided in said first showcase end frame, an outside end panel provided in said second showcase end frame, a plurality of rails connecting said showcase end frames and a main panel extending between a pair of said plurality of rails and a right hand showcase top assembly provided on said right hand showcase base;

a generally elongated box top assembly carried by said center showcase and having a pair of spaced-apart end frame assemblies and a plurality of rails extending between said end frame assemblies;

wherein each of said end frame assemblies of said box top assembly comprises an end frame, an end frame hanging rack provided in said end frame and an end frame insertion panel provided in said end frame adjacent to said end frame hanging rack;

left and right rack assemblies carried by said left hand showcase and said right hand showcase, respectively, and oriented at an obtuse angle with respect to a longitudinal axis of said left hand showcase and said right hand showcase, respectively, and coextensive with a combined height of said center showcase and said box top assembly;

wherein each of said left and right rack assemblies comprises a generally U-shaped rack assembly frame, a hanging rack having a plurality of rack rods spanning said rack assembly frame, a reinforcing member extending transversely to said plurality of rack rods and a rack assembly insert panel provided in said rack assembly frame adjacent to said hanging rack;

a top panel carried by said box top assembly and said left and right rack assemblies;

a module interior defined by and between said center showcase, said left hand showcase, said right hand showcase, said box top assembly, said left rack assembly, said right rack assembly and said top panel; and a panel gap defined by and between said left rack assembly and said right rack assembly and communicating with said module interior.

22. The modular checkout counter of claim 21 further comprising at least one attachment pin carried by said rack assembly frame of each of said left and right rack assemblies and at least one attachment pin receptacle carried by each of said left hand showcase and said right hand showcase and receiving said at least one attachment pin.

23. The modular checkout counter of claim 21 wherein said left hand showcase top assembly and said right hand showcase top assembly each comprises a pair of generally parallel, spaced-apart longitudinal frame members; a pair of transverse frame members extending between said longitudinal frame members; and a top assembly panel mounted between said longitudinal frame members and said transverse frame members.

24. The modular checkout counter of claim 23 further comprising a scan slot provided in said top assembly panel.

* * * * *